United States Patent [19]

Magee

[11] Patent Number: 4,816,284

[45] Date of Patent: Mar. 28, 1989

[54] METHOD FOR MARKING AND DECORATING PLASTIC PANELS

[76] Inventor: Ted N. Magee, 948 Jackling Dr., Hillsborough, Calif. 94010

[21] Appl. No.: 130,136

[22] Filed: Dec. 8, 1987

[51] Int. Cl.[4] ..... B05D 3/12; B05D 1/06; B05D 5/00

[52] U.S. Cl. ..... 427/11; 427/198; 427/199; 427/289

[58] Field of Search ..... 427/11, 197–199, 427/289, 290

[56] References Cited

U.S. PATENT DOCUMENTS

| | | | |
|---|---|---|---|
| 2,016,600 | 10/1935 | Gray | 427/198 |
| 3,765,923 | 10/1973 | Bender-Christensen | 427/290 X |
| 4,446,362 | 5/1984 | Heyman | 235/462 |

*Primary Examiner*—Evan Lawrence
*Attorney, Agent, or Firm*—Townsend and Townsend

[57] ABSTRACT

Apparatus and method for marking plastic panels which then are capable of being laminated at temperatures above 500° F. These panels can be marked before or after being formed. The marking method is accomplished with the use of fluid pressure for directing a mixture of a particulate abrasive material and particulate coloring material under high pressure toward and onto a surface of a plastic panel to be marked. The coloring material particles are of sufficiently small particle size to coat the abrasive particles, so that the coloring material is carried by the abrasive material particles toward and onto the surface to be marked at high speed. When the coated abrasive particles strike the surface to be marked, the colored particles are effectively embedded below the surface of the plastic surface and in position so that they cannot be removed by cleaning detergents and the like. The abrasive particles rebound from the plastic member after depositing the colored coating therefrom, following which the plastic member is permanently marked with the coloring material and with a desired design.

14 Claims, 1 Drawing Sheet

METHOD FOR MARKING AND DECORATING PLASTIC PANELS

This invention relates to improvements in the application of decorative designs to plastic panels or other structural members and, more particularly, to an apparatus and method for marking the surfaces of plastic panels.

BACKGROUND OF THE INVENTION

In the manufacture of airplane interiors for commercial airplanes, the inner surfaces of the fuselage are typically covered with hard panels adjacent to the airplane seats. Such panels are usualy of plastic and are produced by laminating under high heat and pressure. Sandwiched within the laminations are various color silkscreened inks. These inks cannot withstand laminating temperatures above 350° F. New plastics recently developed for fire safety and lower burn rates require laminating temperatures above 500° F. Since this lamination cannot be done with the use of conventional silkscreening of inks and other decorative techniques, a need has arisen for improvements in the marking and decorating of plastic panels for airplane interiors and other uses. The present invention satisfies this need.

SUMMARY OF THE INVENTION

The present invention is directed to an apparatus and method for marking plastic panels in which the panels can be marked before or after being laminated. The marking method is accomplished with the use of fluid pressure for directing a mixture of an abrasive material and coloring material under high pressure toward and onto a surface of a plastic panel or member to be marked. The coloring material is formed of particles and is of sufficiently small particle size to coat the abrasive, which is also of particles, so that the coloring material is carried by the abrasive material particles toward and onto the surface to be marked at high speed.

When the coated abrasive particles strike the surface to be marked, the colored particles are effectively embedded below the surface of the plastic surface and in position so that they cannot be removed by cleaning detergents and the like. The abrasive particles rebound from the plastic member after depositing the colored coating therefrom, following which the plastic member is permanently marked with the coloring material and with a desired design.

The apparatus of the present invention preferably includes an air gun having a mixture of the abrasive materials and the colored materials therein, which mixture is directed by suction into an air stream at relatively high pressure so that the mixture of the abrasive materials and colored particles are directed at high speeds onto the surface of the plastic material to be marked.

The primary object of the present invention is to provide an improved apparatus and method for marking plastic members, such as panels forming an airplane interior wherein a mixture of abrasive particles and colored particles are directed toward the surface to be marked at high speed and pressure to cause the colored particles carried by the abrasive particles to be embedded below the surface of the plastic material so as to provide a permanent design therefor and one which cannot be removed by conventional cleaning techniques.

Other objects of this invention will become apparent as the following specification progresses, reference being had to the accompanying drawings for an illustration of the invention.

A panel adapted to be marked in accordance with the teachings of the present invention is broadly denoted by the number 10 and can be of any suitable hard plastic material. A suitable material for this purpose is one known as polyetherimide. The panel can be of any suitable size, shape or configuration. For purposes of illustration, panel 10 has a flat front face 12 but the face need not be flat. Moreover, the panel can be of any thickness and can have any surface finish, if desired.

Figure 1:
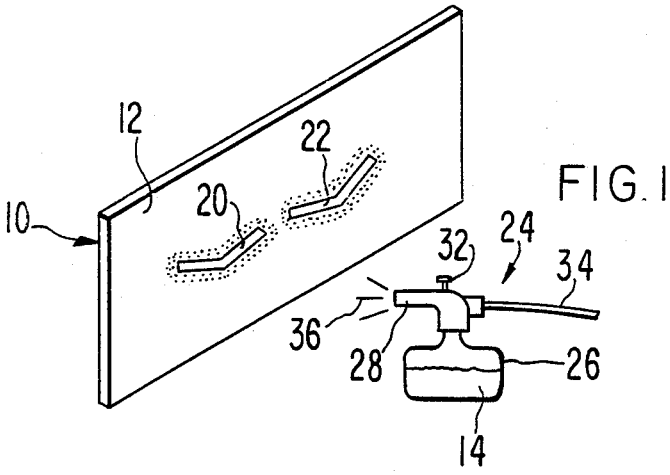
FIG. 1 is a schematic view of a panel having a surface to be marked and an air gun for directing a color-coated abrasive material onto one surface of the panel for marking the panel permanently.
Figure 2:
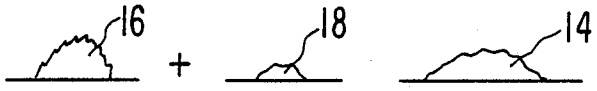
FIG. 2 is a schematic view of the way in which the abrasive material is mixed with color particles to form the mixture.

The purpose of the present invention is to provide an apparatus and method for marking a surface, such as front face 12, of panel 10. The marking media is a mixture 14 (FIG. 2) of an abrasive material 16 having particles coated with a coloring material 18 in the form of particles. The mixture is formed in any suitable manner, such as by mixing the abrasive materials 16 and 18 in a container to form mixture 14.

The abrasive particles can be sand particles, aluminum oxide particles and other hard, abrasive particles which can be natural or synthetic with various grit sizes.

Mixture 14 is delivered under high pressure to panel 10 after a template, mask or other design-defining article is placed on the surface of panel 10 to be marked. For purposes of illustration, panel 10 shows a pair of templates 20 and 22 applied in any suitable manner to panel face 12 to be marked. A suitable air gun 24 is used for delivering the mixture. The air gun includes a container 26 having a nozzle 28 coupled therewith in any suitable manner, such as by an internally threaded sleeve 30. A control member 32 is used for controlling the amount of flow of mixture 14 from container 26 by suction when an air source under pressure is coupled by a hose 34 to nozzle 28. The flow of air under pressure through the nozzle causes a suction force to draw out mixture 14 from container 26 through nozzle 28 and as a spray 36 directed toward and onto face 12 of panel 10. In this way, the mixture 14 is moved in marking relationship to the panel face 12 over the templates 20 and 22.

The gun may be of any suitable size and capacity. For purposes of illustration, the orifice on nozzle 28 is in the range of $\frac{1}{4}$ inch to $\frac{1}{2}$ inch, preferably about $\frac{3}{8}$ inch. The air pressure supplied to the gun 24 is in the range of 100–150 psi, more suitably 115–130 psi and preferably about 120 psi. The air gun 24 is aimed at the panel face 12 from any suitable looation, such as a location 3 to 6 inches away from the face.

The coloring material 18 can be of any particle structure. The colored particles are smaller in particle size than the particles of abrasive material 16. The colored particles are of a size above 325 mesh and have a consistency preferably of baby powder or talcum powder. The particles of coloring material 18 coat the particles of abrasive material 16 when the particles are mixed to form mixture 14. When the mixture accelerates out of the air gun through nozzle 28, the colored particles are attached to the abrasive particles as a coating (FIG. 3) and are carried by the abrasive particles toward face 12 of panel 10 in marking relationship to the panel face 12.

Suitable coloring material comprising material 18 is materials known as "Glaze Stain" made and sold by Leslie Ceramic Supply of Berkeley, California. Typical color materials suitable for the foregoing purpose is one known as cobalt oxide for providing the color blue and lead antimony for producing the color orange. Other materials can be used to produce other colors. It has been found that color materials used for coloring molten glass are especially suitable for this purpose.

Mixture 14 includes a greater amount of abrasive material 16 than coloring material 18. There are 5–15 parts of the materials 16 to one part of coloring material, more preferably 8–12 parts of abrasive material to one part of coloring material and most preferably 10 parts of abrasive material to one part of coloring material.

Figure 3:
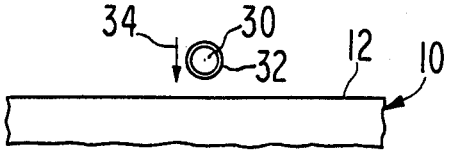
FIG. 3 is a schematic view of the panel and a color-coated abrasive particle moving at high speed toward the panel.
Figure 4:
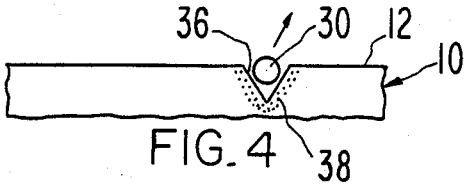
FIG. 4 is a schematic view of the panel, showing the way in which an abrasive material particle with the color particles thereon penetrates the surface of the plastic and deposits the color material permanently in the plastic below the surface thereof.
Figure 5:
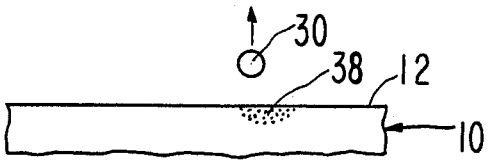
FIG. 5 is a view similar to FIG. 3 but showing the way in which the surface of the plastic looks after the plastic material has sprung back after being struck by the abrasive materials.

The particles of abrasive material 16 are coated with the coloring material 18 as shown in FIG. 3 wherein an abrasive particle 30 is provided with a coating 32 of material 18 thereon as the particle travels at high speed in the direction of arrow 34 toward face 12 of panel 10. As the coated particle 30 strikes the face 12, the particle forms a recess 36 in the face 12 and, as it does, it imparts the coloring material to the surface adjacent to the particle so that the coloring material is effectively embedded below the surface of the material as shown by the dotted region 38 in FIG. 3. The abrasive particle 30 rapidly rebounds from face 12 and moves away from surface 12 as shown in FIG. 4, whereupon the recess 36 at least partially closes, leaving the coloring material in region 38 below the surface 12 and permanently a part of plastic panel 10. The region 38 is sufficiently close to the surface so that the original color of material 18 making up region 3B is vivid and without any decrease in the quality of the color notwithstanding the fact that the region is microscopically below the surface 12 of panel 10.

In use, panel 10 to be marked is provided with templates 20 and 22 which can be a soft material which does not form recesses, such as recesses 36 when struck by the abrasive material 16. A soft vinyl material is suitable for this purpose. With the panel 10 supported from the back, mixture 14 is placed in container 26 of air gun 24 and air under pressure is supplied by hose 34 to the air gun. Suction created by the flow of air through the nozzle of the air gun causes mixture 14 to be drawn by suction upwardly in container 26 and into the air stream where it is sprayed onto templates 20 and 22 and onto the adjacent region of panel face 12, leaving a marked region surrounding the outlines of the templates. The templates are then removed, leaving the marked panel face 12 with the desired design on it.

The design is permanently embedded in the panel face. Abrasive material, such as a household detergent, will not take it off even by scrubbing with an abrasive pad or cloth. Moreover, the panel 10 can be subjected to relatively high temperatures such as in the neighborhood of 450°–600 degrees Fahrenheit without affecting it. Thus, the panel can be marked by the method of the present invention before the panel is formed, thereby allowing the marking to be done on a flat panel which is easier to work with than a formed panel.

I claim:

1. A method for marking the surface of a plastic member comprising:

forming a mixture of a particulate abrasive material and a particulate coloring material; and directing the mixture as a stream under pressure toward and against the surface of the plastic member sufficient to cause the coloring material to strike and penetrate the plastic member below the surface thereof; as the particles of abrasive material rebound from the surface.

2. The method as set forth in claim 1, wherein the particles of the coloring material form a coating on the particles of abrasive material.

3. The method as set forth in claim 1, wherein the pressure of the stream of mixture is in the range of 100–150 psi.

4. The method as set forth in claim 1, wherein the pressure of the stream of mixture is in the range of 115–130 psi.

5. The method as set forth in claim 1, wherein the pressure of the mixture stream is 120 psi.

6. The method as set forth in claim 1, wherein is further included a step of placing a template on the surface before such stream is directed onto the surface to provide a design therefor when the mixture is directed against said surface.

7. The method as set forth in claim 6, wherein the panel member is of a relatively hard plastic and said template is of a relatively soft plastic material.

8. The method as set forth in claim 1, wherein said abrasive material is formed of sand particles.

9. The method as set forth in claim 1, wherein said abrasive material is aluminum oxide particles.

10. The method as set forth in claim 1, wherein the colored material particles are of a size sufficient to coat the abrasive particles.

11. The method as set forth in claim 1, wherein said step of directing the mixture includes creating a flow of air under pressure and drawing the mixture by suction into the air flow.

12. The method as set forth in claim 1, wherein said plastic member is of polyetherimide.

13. The method as set forth in claim 1, wherein said plastic member is of polycarbonate.

14. The method of claim 1, wherein the particle size of the colored material is above 325 mesh.

* * * * *